US010144603B2

(12) United States Patent
Aoki

(10) Patent No.: US 10,144,603 B2
(45) Date of Patent: Dec. 4, 2018

(54) MEDIUM TRANSPORTATION DEVICE AND RECORDING APPARATUS

(71) Applicant: SEIKO EPSON CORPORATION, Tokyo (JP)

(72) Inventor: Takeshi Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/660,567

(22) Filed: Jul. 26, 2017

(65) Prior Publication Data

US 2018/0044127 A1 Feb. 15, 2018

(30) Foreign Application Priority Data

Aug. 10, 2016 (JP) ..... 2016-157896

(51) Int. Cl.
*B65H 3/52* (2006.01)

(52) U.S. Cl.
CPC ..... *B65H 3/5261* (2013.01); *B65H 3/5207* (2013.01); *B65H 2402/521* (2013.01); *B65H 2402/64* (2013.01); *B65H 2403/72* (2013.01); *B65H 2404/133* (2013.01); *B65H 2404/152* (2013.01); *B65H 2404/17* (2013.01); *B65H 2405/325* (2013.01)

(58) Field of Classification Search
CPC ..... B65H 3/5207; B65H 3/5261; B65H 2402/515; B65H 2402/521; B65H 2402/60; B65H 2402/64; B65H 2404/17
See application file for complete search history.

(56) References Cited

U.S. PATENT DOCUMENTS

| | | | | |
|---|---|---|---|---|
| 9,783,380 | B2 * | 10/2017 | Kuriki | B65H 3/0661 |
| 9,904,228 | B2 * | 2/2018 | Xie | B65H 3/06 |
| 9,994,404 | B2 * | 6/2018 | Ngoc | G03G 15/20 |
| 2004/0256787 | A1 * | 12/2004 | Wada | B65H 3/0669 271/109 |
| 2007/0145666 | A1 * | 6/2007 | Nishikata | B65H 3/0638 271/18 |
| 2009/0295069 | A1 * | 12/2009 | Shiina | G03G 15/6511 271/126 |
| 2015/0123340 | A1 * | 5/2015 | Kannari | B65H 3/0669 271/117 |
| 2018/0016107 | A1 * | 1/2018 | Ngoc | G03G 15/20 |

FOREIGN PATENT DOCUMENTS

| | | |
|---|---|---|
| JP | 2004-262597 A | 2/2003 |
| JP | 2015-059030 A | 3/2015 |

* cited by examiner

*Primary Examiner* — Michael C McCullough
(74) *Attorney, Agent, or Firm* — Workman Nydegger

(57) ABSTRACT

A medium transportation device includes a transportation driving roller that transports a medium; a roller unit including a separation roller as a driven roller that is rotated by rotation of the transportation driving roller and a shaft which penetrates a rotation center of the separation roller; a holder that detachably holds the roller unit; and a lock mechanism that switches between an unlocked state in which the roller unit is unlocked from the holder and a locked state in which the roller unit is locked to the holder.

14 Claims, 13 Drawing Sheets

MEDIUM TRANSPORTATION DEVICE AND RECORDING APPARATUS

INCORPORATED BY REFERENCE

The entire disclosure of Japanese Patent Application No. 2016-157896, filed Aug. 10, 2016 is expressly incorporated by reference herein.

BACKGROUND

1. Technical Field

The present disclosure relates to medium transportation devices that transport a medium, and recording apparatuses that include the medium transportation device.

2. Related Art

Some types of recording apparatus, which is typically a printer, includes a sheet cassette detachable to the apparatus main body, and is configured to transport a medium housed in the sheet cassette to a recording area in a recording unit by means of a medium transportation device. An example of such a recording apparatus is disclosed in JP-A-2015-59030.

In JP-A-2015-59030, the medium transportation device includes a transportation roller disposed on the apparatus main body and a separation roller disposed on the sheet cassette, and the separation roller is biased toward the transportation roller by a biasing unit. More specifically, the separation roller is disposed on a holder, and the bias unit is disposed to bias the holder.

The separation roller may be replaced with new one by a service person or a user when it is deteriorated due to abrasion or the like caused by continuous use. Since the holder is biased by the biasing unit as described above, removing the holder for replacement of the separation roller causes a complicated operation. Accordingly, the separation roller may be configured to be detached from the holder for replacement. JP-A-2004-262597 discloses a pressure roller attachment and detachment mechanism that allows for replacement of the pressure roller serving as the separation roller in a simple manner.

In some cases, a lock mechanism may be provided to prevent the separation roller, which is configured to be detachable to the holder, from being inadvertently removed from the holder. However, when the separation roller is attached to the holder after being removed from the holder for replacement of the roller, an operator such as a service person and a user may forget to lock the separation roller by the lock mechanism. If the separation roller is not locked, transportation of the medium cannot be performed in a stable manner, leading to a decrease in quality of recording. Furthermore, the separation roller may be detached or displaced from the holder during recording, which may cause a failure in transportation of medium.

SUMMARY

An advantage of some aspects of the disclosure is to ensure locking of the separation roller in a reliable manner during attachment of the separation roller configured to be detachable in the medium transportation device.

According to a first aspect of the disclosure, a medium transportation device includes a transportation driving roller that transports a medium; a roller unit including a driven roller that is rotated by rotation of the transportation driving roller and a shaft which penetrates a rotation center of the driven roller; a holding section that detachably holds the roller unit; and a lock mechanism that switches between an unlocked state in which the roller unit is unlocked from the holding section and a locked state in which the roller unit is locked to the holding section.

In this aspect, the lock mechanism is configured to switch between the unlocked state in which the roller unit is unlocked from the holding section and the locked state in which the roller unit is locked to the holding section by rotating the driven roller in the medium transportation direction. Accordingly, the lock mechanism is ensured to be in the locked state in a reliable manner after the driven roller is attached and detached. For example, in the roller unit which is already attached to the holding section, if the transportation driving roller is driven to start transportation when locking by the lock mechanism is insufficient (in the unlocked state), the lock mechanism can be turned into the locked state by rotation of the driven roller in the medium transportation direction that is rotated by rotation of the transportation driving roller. Accordingly, transportation of the medium while the lock mechanism is in the unlocked state can be reduced or avoided.

According to a second aspect of the disclosure, in the medium transportation device according to the first aspect, the driven roller is configured to rotate integrally with the shaft when the lock mechanism is in the unlocked state, and to be relatively rotatable to the shaft when the lock mechanism is in the locked state, the lock mechanism includes a contact member that is fixed to the shaft and protrudes in a direction perpendicular to an axis direction of the shaft, the holding section includes a first bearing that receives a first end of the shaft, a second bearing that receives a second end, and a regulation member that regulates the shaft from rotating in the medium transportation direction by contact with the contact member in a state in which the first end and the second end are received in the first bearing and the second bearing, respectively, and in the lock mechanism, the locked state is a state in which the contact member is in contact with the regulation member, and the unlocked state is a state in which the shaft has been rotated from the locked state in a direction opposite to the medium transportation direction and the contact member is spaced from the regulation member.

In this aspect, a configuration in which the lock mechanism becomes the locked state from the unlocked state by rotation of the driven roller in the medium transportation direction can be achieved. Detailed locking operation of the lock mechanism will be described later.

According to a third aspect of the disclosure, in the medium transportation device according to the second aspect, the first end of the shaft has a cross section of a circular shape in a direction perpendicular to an axis direction, and the second end has a cross section of a truncated circular shape which is made up of an arch portion and a flat portion, and the contact member is disposed on the second end.

In this aspect, the contact member disposed on the second end which has a cross section of a truncated circular shape which is made up of an arch portion and a flat portion. Accordingly, the contact member can be more reliably fixed to the shaft.

According to a fourth aspect of the disclosure, in the medium transportation device according to the third aspect, the first bearing is a shaft hole disposed on a first wall, which is one of a pair of walls disposed on both sides in the axis direction of the shaft in the holding section, and allows the first end of the shaft to be inserted therein, and the second bearing is a groove disposed on a second wall of the pair of walls and allows the second end of the shaft to be inserted therein from above the second wall.

In this aspect, the first bearing is a shaft hole disposed on a first wall, which is one of a pair of walls disposed on both sides in the axis direction of the shaft in the holding section, and allows the first end of the shaft to be inserted therein, and the second bearing is a groove disposed on a second wall of the pair of walls and allows the second end of the shaft to be inserted therein from above the second wall. Accordingly, the roller unit can be easily mounted to the holding section. Further, since the first end of the shaft is fitted into the first bearing which is formed as a shaft hole, the roller unit can be more reliably mounted to the holding section.

According to a fifth aspect of the disclosure, in the medium transportation device according to the second or third aspect, the first bearing is a first groove disposed on a first wall, which is one of a pair of walls disposed on both sides in the axis direction of the shaft in the holding section, and allows the first end of the shaft to be inserted therein from above the first wall, and the second bearing is a second groove disposed on a second wall of the pair of walls and allows the second end of the shaft to be inserted therein from above the second wall.

In this aspect, since both the first bearing and the second bearing are formed as a groove, the first end and the second end can be more easily mounted in the corresponding receiving sections (the first bearing and the second bearing).

According to a sixth aspect of the disclosure, in the medium transportation device according to any one of the second to fifth aspects, the contact member includes a tab which extends in a direction perpendicular to the axis direction of the shaft.

In this aspect, since the contact member includes a tab which extends in a direction perpendicular to the axis direction of the shaft, switching of the lock mechanism between the locked state and the unlocked state can be performed with a simple operation by holding the tab by hand and rotating the shaft of the roller unit.

According to a seventh aspect of the disclosure, in the medium transportation device according to the fourth aspects, the contact member includes a tab disposed on the second end and extends in a direction perpendicular to the axis direction of the shaft, and a tongue disposed on an opposite side to the tab with the shaft interposed therebetween, the tongue being elastically deformable in the axis direction and provided with a projection on a surface facing the second wall, and the second wall includes a recessed portion which faces the projection of the tongue with a space therebetween in the unlocked state of the lock mechanism, and a raised portion which presses the projection to elastically deform the tongue toward inside in the axis direction of the shaft while the lock mechanism transitions from the unlocked state to the locked state.

In this aspect, since the second wall includes a recessed portion which faces the projection of the tongue with a space therebetween in the unlocked state of the lock mechanism, the roller unit can be easily set in the holding section. Moreover, since the second wall includes a raised portion which presses the projection to elastically deform the tongue toward inside in the axis direction of the shaft while the lock mechanism transitions from the unlocked state to the locked state, the lock mechanism can be switched from the unlocked state to the locked state while positioning the shaft of the roller unit of the holding section in the axis direction.

According to an eighth aspect of the disclosure, in the medium transportation device according to the seventh aspects, the second wall includes an inclined surface which is continuous from the recessed portion to the raised portion.

In this aspect, since the second wall includes the inclined surface which is continuous from the recessed portion to the raised portion, the projection of the tongue can be guided by the inclined surface, allowing the projection to smoothly move from the recessed portion to the raised portion. Accordingly, the lock mechanism can be smoothly switched from the unlocked state to the locked state.

According to a ninth aspect of the disclosure, in the medium transportation device according to the seventh or eighth aspect, the second wall includes a step which serves to release elastic deformation of the tongue on the raised portion when the lock mechanism becomes the locked state.

In this aspect, since the second wall includes a step which serves to release elastic deformation of the tongue on the raised portion when the lock mechanism becomes the locked state, an operator can readily recognize when the lock mechanism becomes the locked state.

According to a tenth aspect of the disclosure, in the medium transportation device according to any one of the fourth and seventh to ninth aspects, at least one of the first end and the first bearing of the shaft has a guiding feature that guides insertion of the first end into the first bearing.

In this aspect, since at least one of the first end and the first bearing of the shaft has a guiding feature that guides insertion of the first end into the first bearing, the first end can be easily inserted into the first bearing.

According to an eleventh aspect of the disclosure, in the medium transportation device according to any one of the second to tenth aspects, the driven roller is a separation roller that cooperates with the transportation driving roller to nip the medium therebetween for separation, and the roller unit includes a torque limiter that limits rotation of the separation roller relative to the shaft at a torque less than a predetermined value.

In this aspect, when the driven roller is a separation roller that cooperates with the transportation driving roller to nip the medium therebetween for separation, the same effects as those of any one of the second to sixth aspects can be obtained. Further, when the roller unit includes a torque limiter that limits rotation of the separation roller relative to the shaft at a torque less than a predetermined value, the separation roller serving as the driven roller rotates integrally with the shaft when the roller unit is in the unlocked state and is relatively rotatable to the shaft when the roller unit is in the locked state.

According to a twelfth aspect of the disclosure, a recording apparatus includes a recording unit that performs recording on the medium; and the medium transportation device according to any one of the first to eleventh aspects that transports the medium to the recording unit.

In this aspect, in the recording apparatus which includes the medium transportation device that transports the medium to the recording unit, the same effects as those of any one of the first to eleventh aspects can be obtained.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

Embodiment 1

Figure 1:
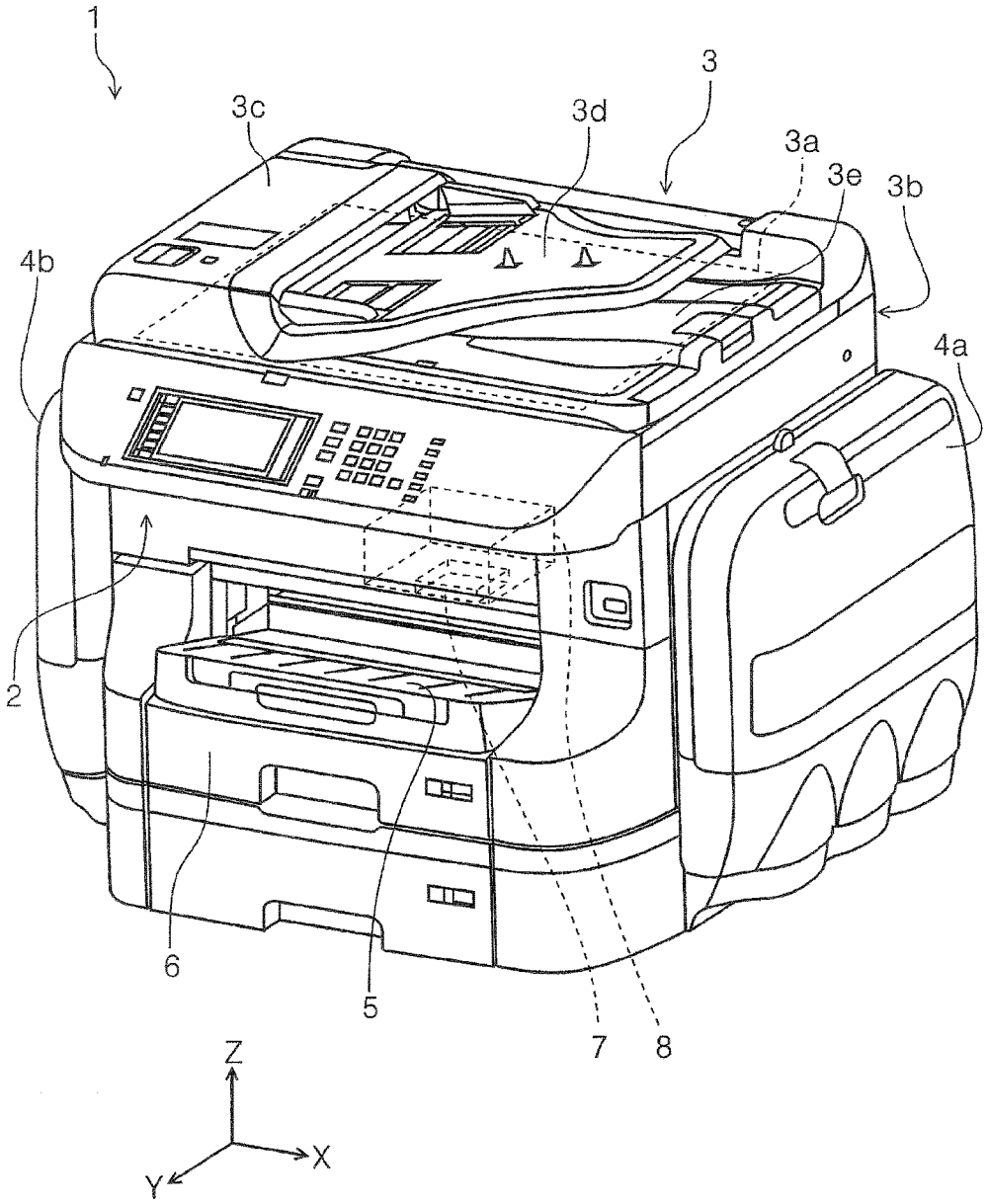
FIG. 1 is an outer appearance perspective view which illustrates an example of a printer according to the disclosure.
Figure 2:
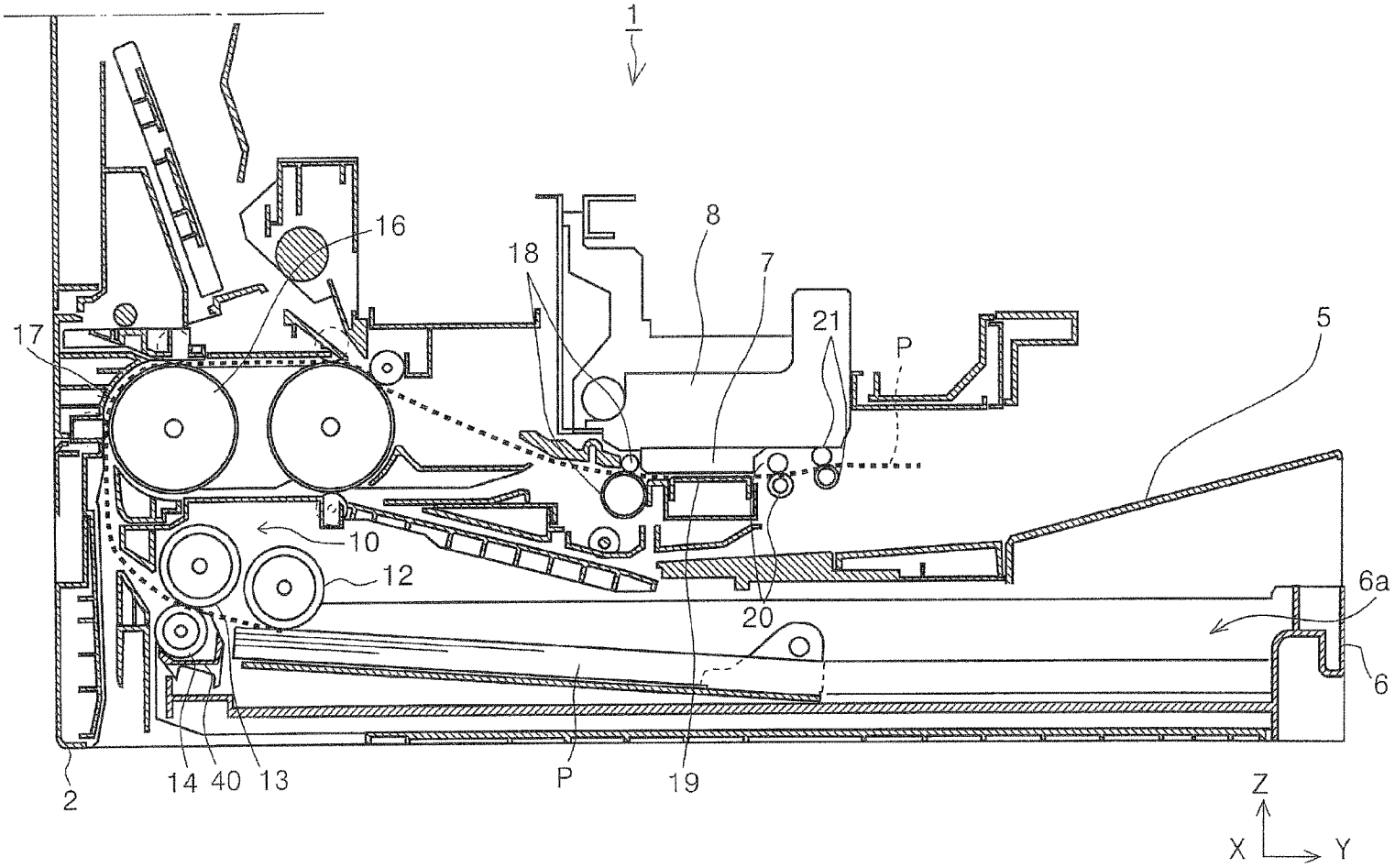
FIG. 2 is a side cross-sectional view which illustrates a sheet transportation path of the printer according to the disclosure.
Figure 3:
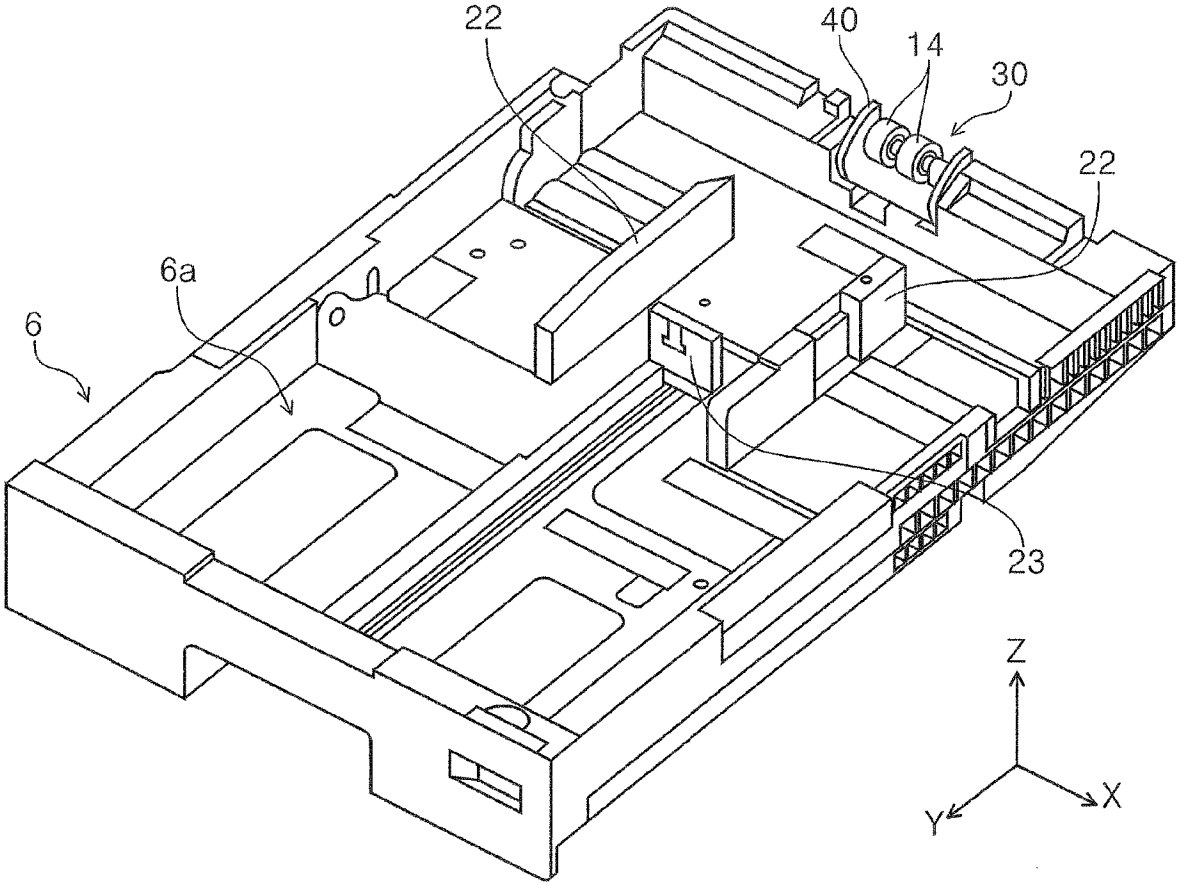
FIG. 3 is a perspective view which illustrates a paper sheet tray of the printer according to the disclosure.
Figure 4:
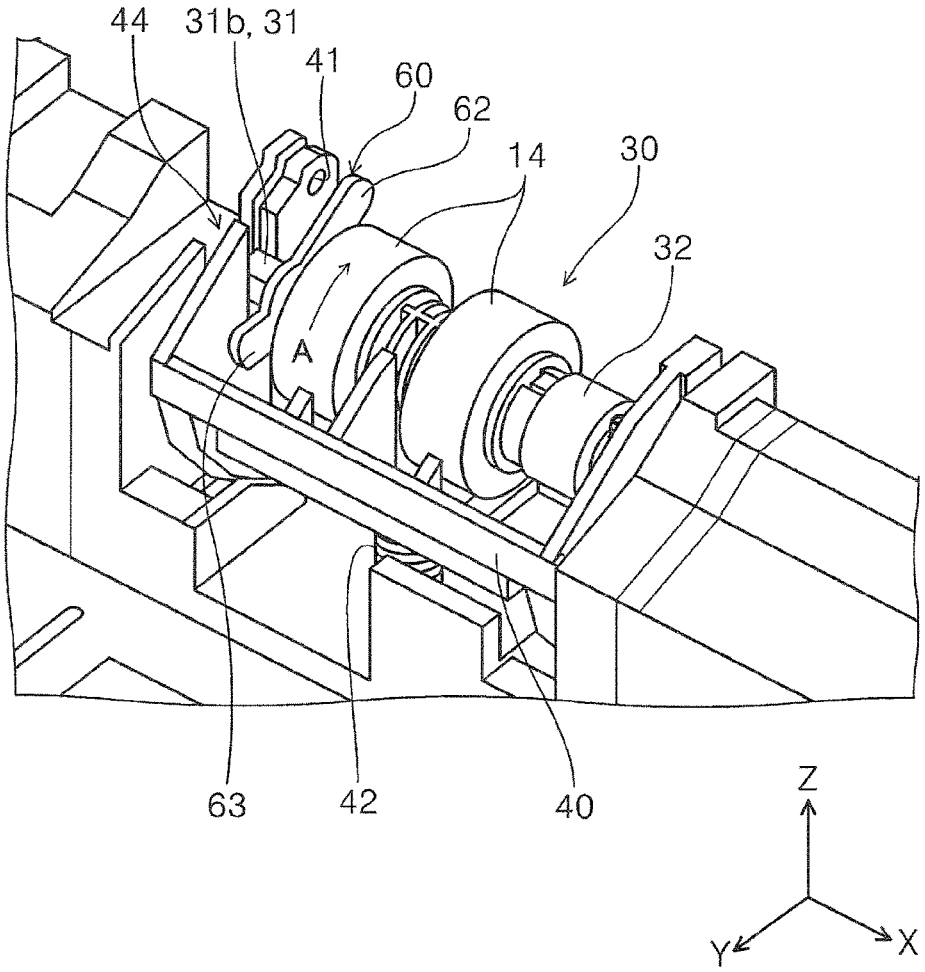
FIG. 4 is an enlarged perspective view of an essential part of the paper sheet tray shown in FIG. 3.
Figure 5:
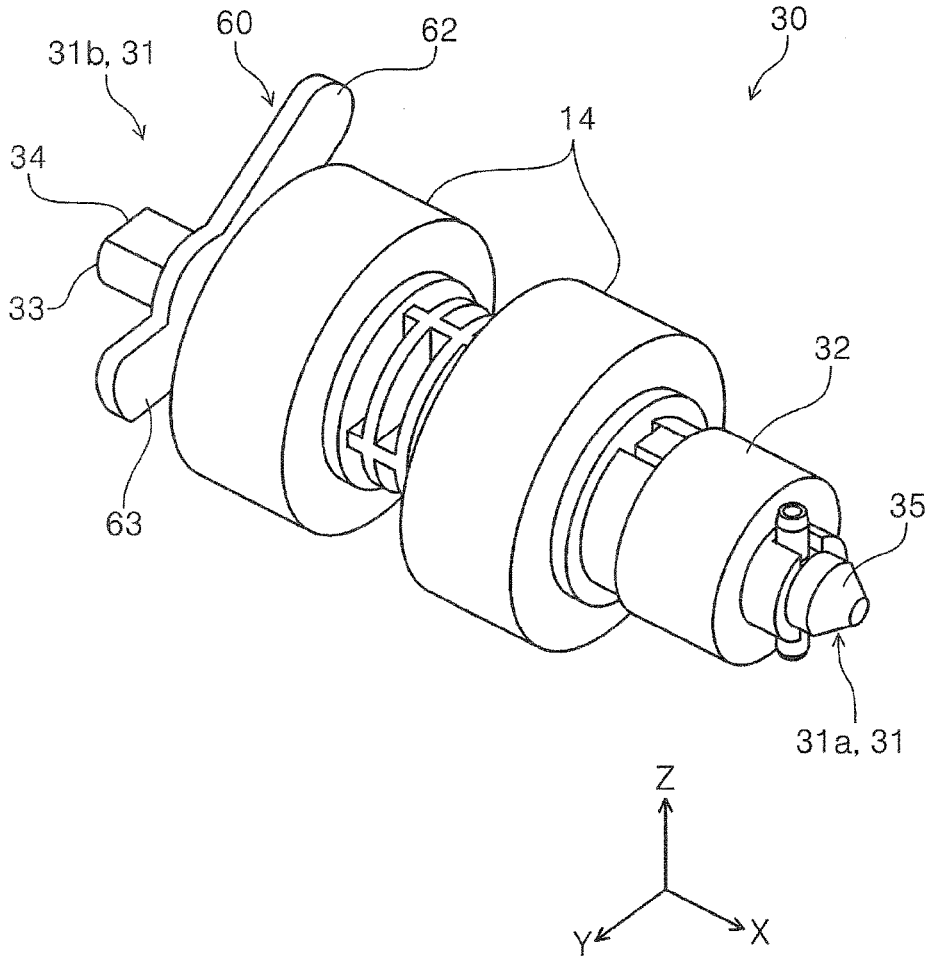
FIG. 5 is a perspective view of a roller unit.
Figure 6:
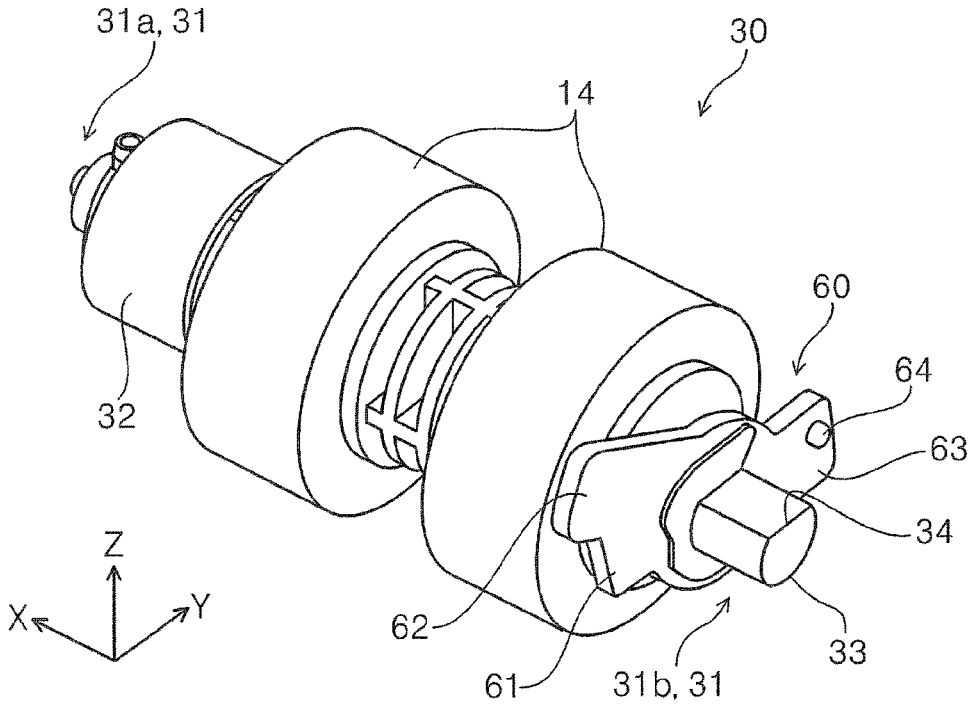
FIG. 6 is a perspective view of the roller unit shown in FIG. 5 as viewed in another angle.

First, an outline of a recording apparatus according to one embodiment of the disclosure will be described. In the present embodiment, an ink jet printer (hereinafter, simply referred to as a printer) will be described as an example of a recording apparatus. FIG. 1 is an outer appearance perspective view of an example of a printer according to the disclosure. FIG. 2 is a side cross-sectional view which illustrates a sheet transportation path of the printer according to the disclosure. FIG. 3 is a perspective view which illustrates a paper sheet tray of the printer according to the disclosure. FIG. 4 is an enlarged perspective view of an essential part of the paper sheet tray shown in FIG. 3. FIG. 5 is a perspective view of a roller unit. FIG. 6 is a perspective view of the roller unit shown in FIG. 5 as viewed in another angle.

Figure 7:
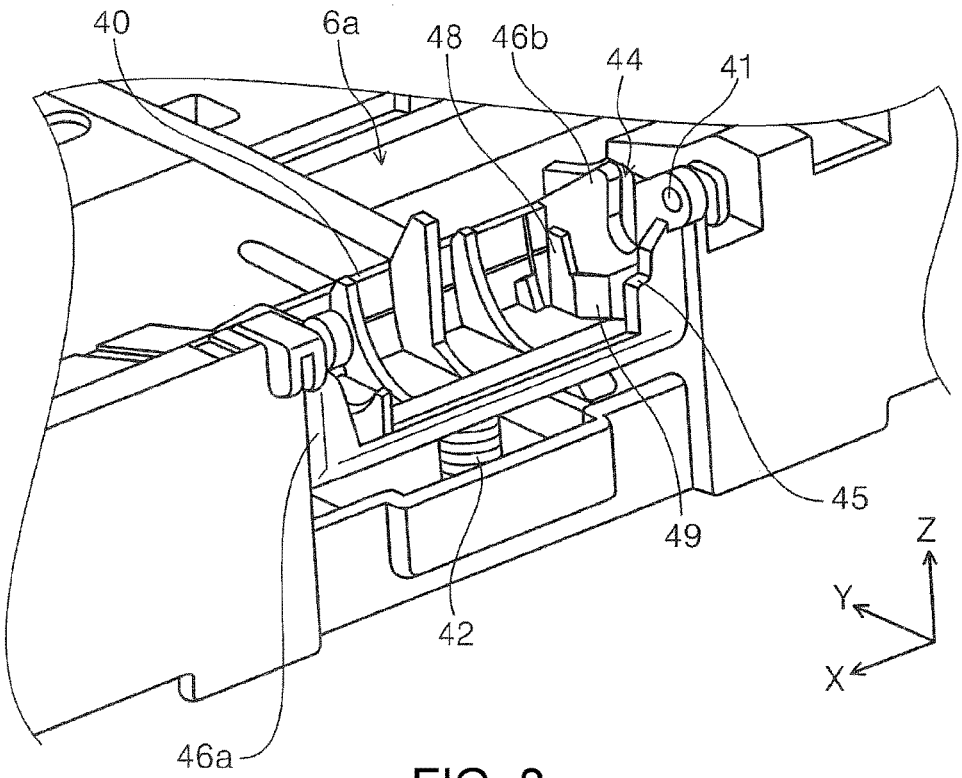
FIG. 7 is a perspective view which illustrates a holder with the roller unit removed.
Figure 8:
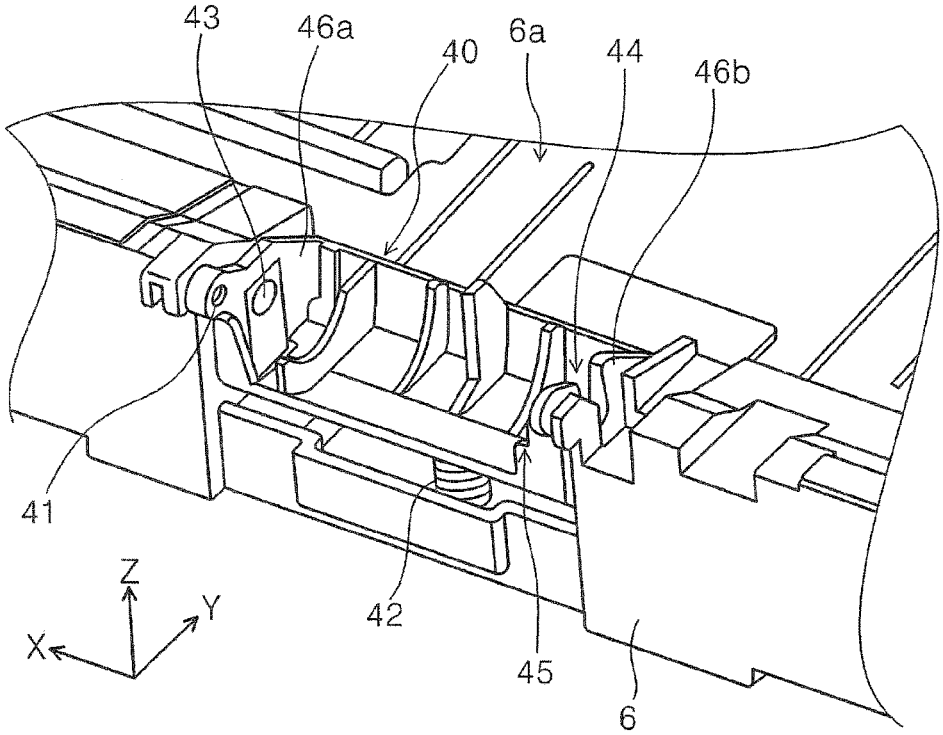
FIG. 8 is a perspective view of the holder shown in FIG. 7 as viewed in another angle.
Figure 9:
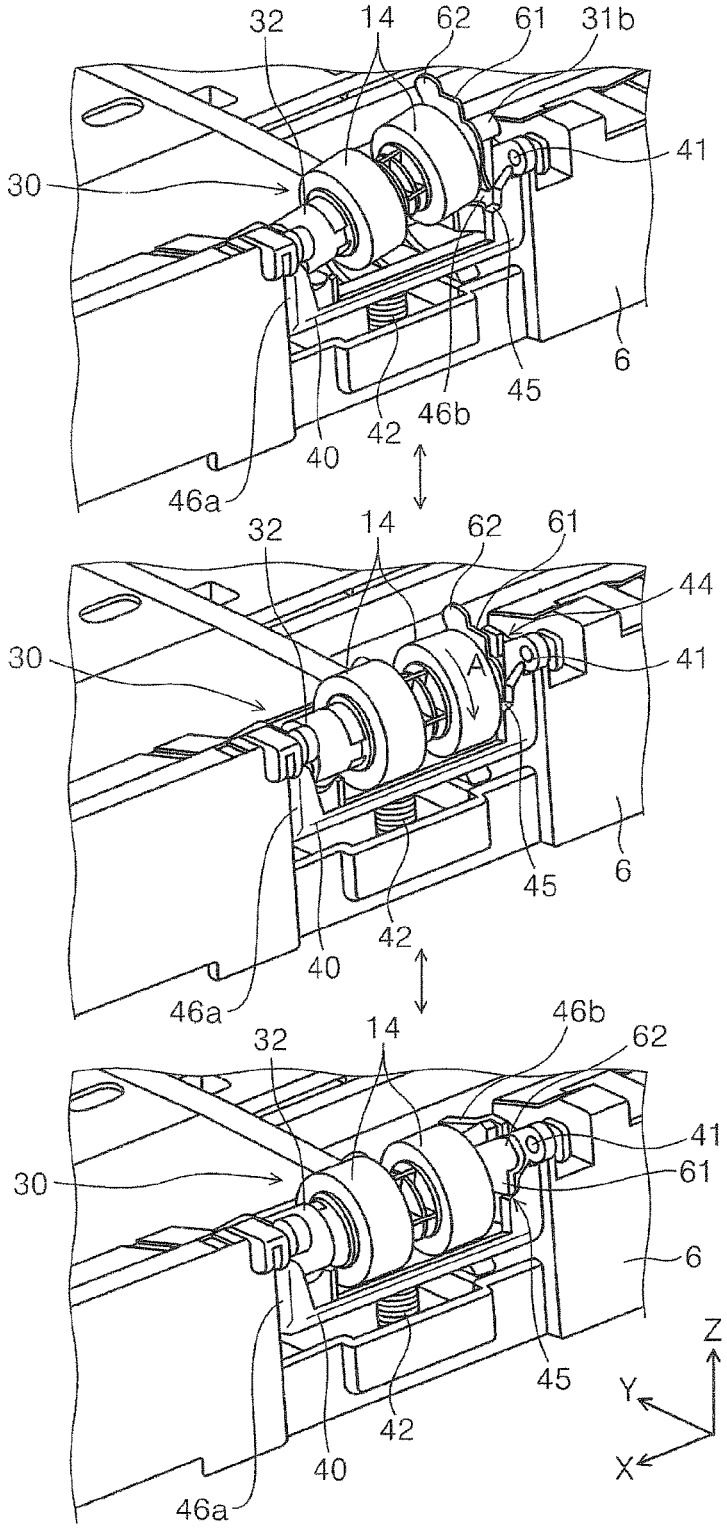
FIG. 9 is a view which illustrates an attachment procedure of the roller unit to the holder and a lock procedure of a lock mechanism.
Figure 10:
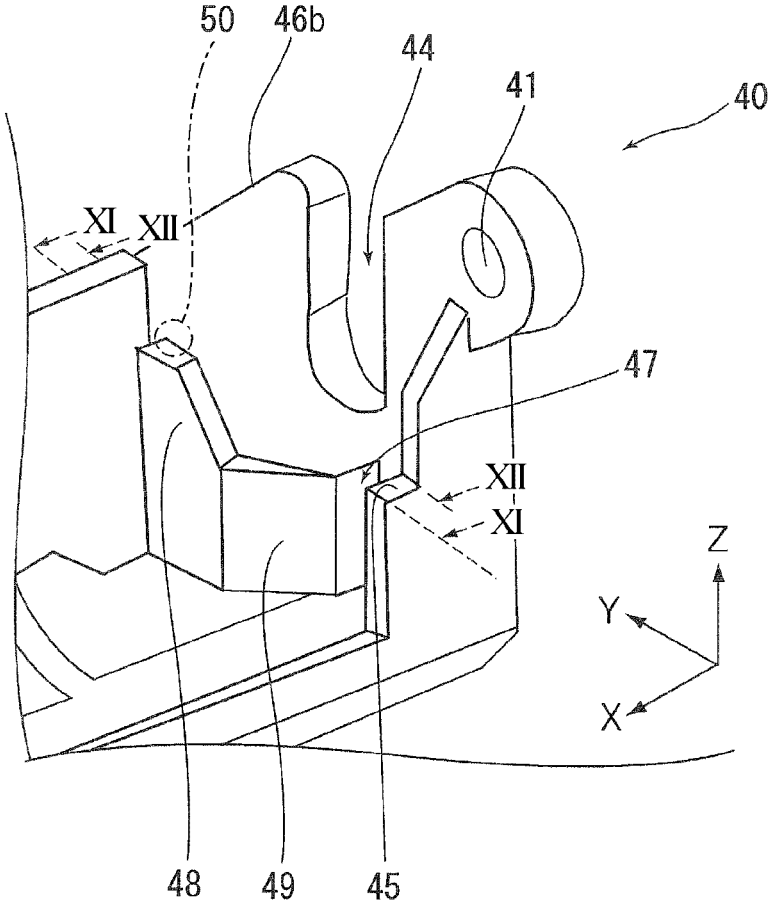
FIG. 10 is an enlarged perspective view of an essential part of the holder.
Figure 11:
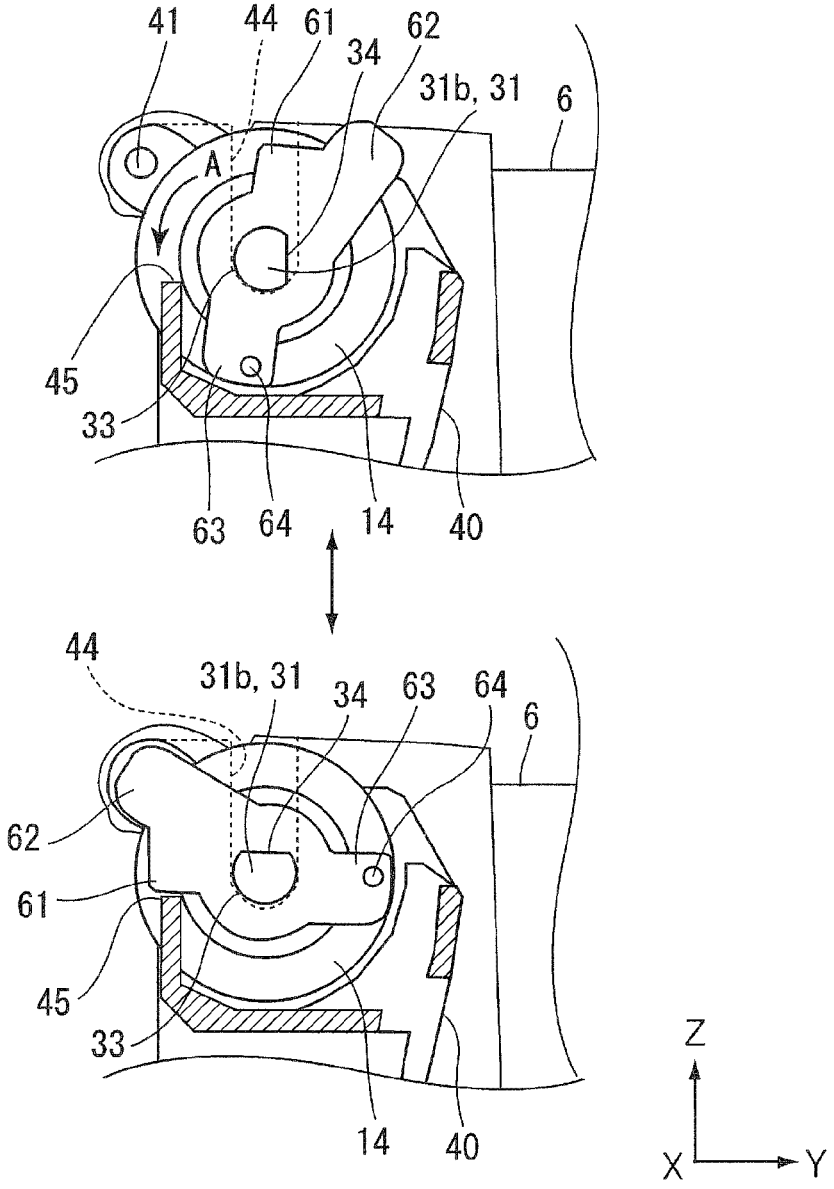
FIG. 11 is a side cross-sectional view which illustrates the lock mechanism in an unlocked state and a locked state.
Figure 12:
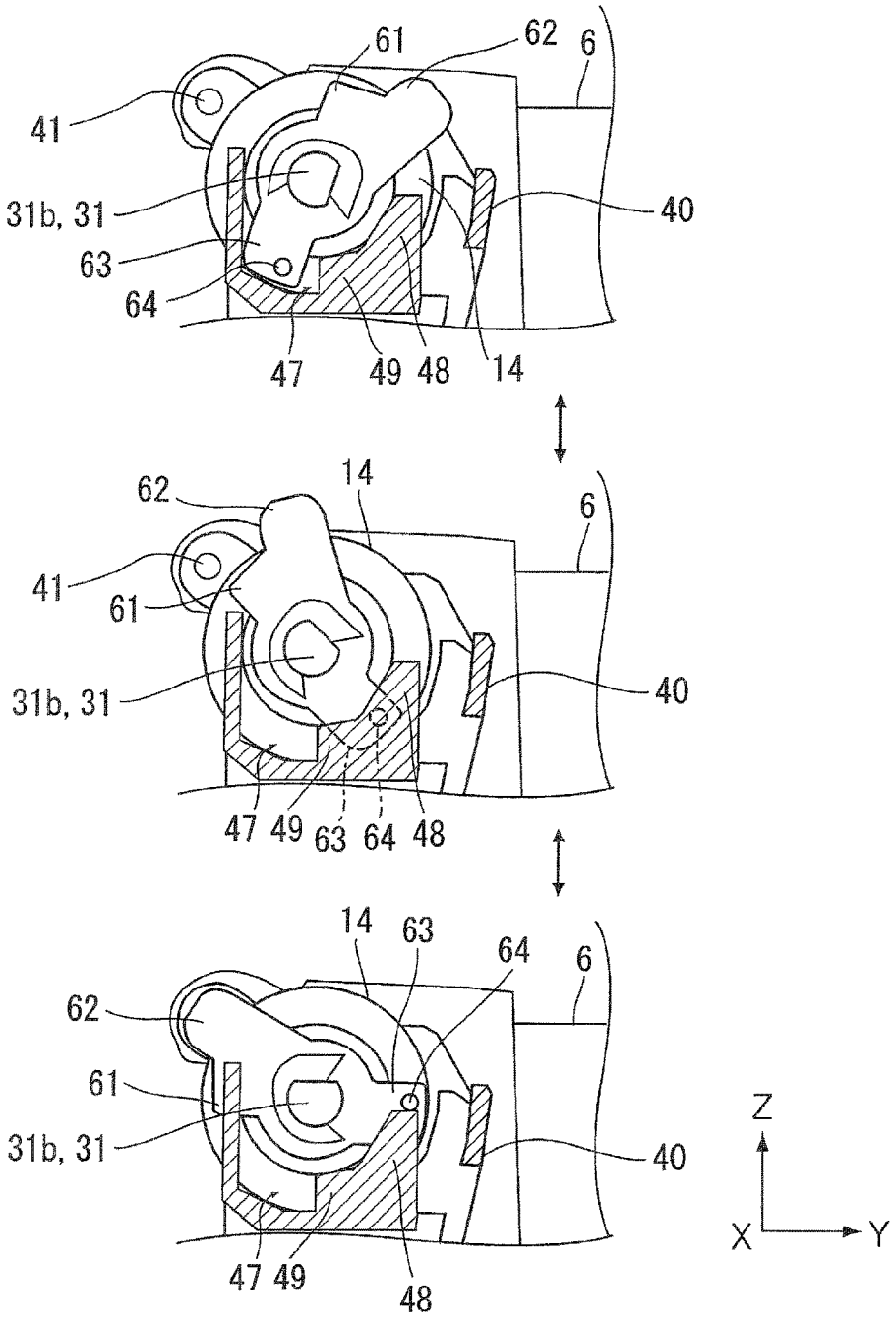
FIG. 12 is a side cross-sectional view which illustrates how a projection moves in the lock mechanism.
Figure 13:
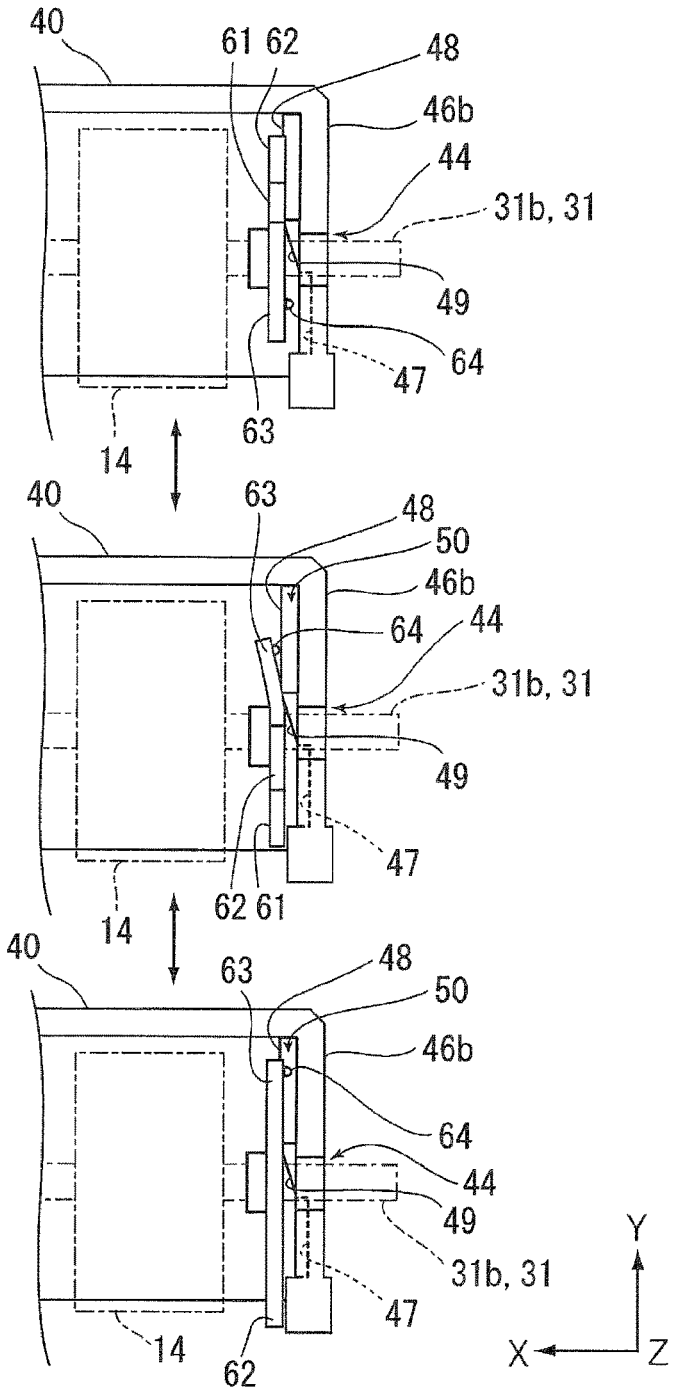
FIG. 13 is a plan view which illustrates how a tongue and the projection move in the lock mechanism.

FIG. 7 is a perspective view which illustrates a holder with the roller unit removed. FIG. 8 is a perspective view of the holder shown in FIG. 7 as viewed in another angle. FIG. 9 is a view which illustrates an attachment procedure of the roller unit to the holder and a lock procedure of a lock mechanism. FIG. 10 is an enlarged perspective view of an essential part of the holder. FIG. 11 is a side cross-sectional view which illustrates the lock mechanism in an unlocked state and a locked state. FIG. 12 is a side cross-sectional view which illustrates how a projection moves in the lock mechanism. FIG. 13 is a plan view which illustrates how a tongue and the projection move in the lock mechanism.

Further, in the X-Y-Z coordinate system in the drawings, the X direction represents a movement direction of a recording head, the Y direction represents a depth direction of the recording apparatus and a medium transportation direction, and the Z direction represents a height direction of the recording apparatus. Throughout the drawings, +Y direction is defined as an apparatus front side, and −Y direction is defined as an apparatus back side. In addition, the direction in which a paper sheet is transported in the printer is referred to as a "downstream," and a direction opposite from the +Y direction (−Y direction) is referred to as an "upstream."

Overall Configuration of Printer

With reference to mainly FIGS. 1 to 5, an overall configuration of a printer 1 will be described. The printer 1 (FIG. 1) according to the disclosure includes an apparatus main body 2 and a scanner unit 3 disposed on the upper side of the apparatus main body 2. The apparatus main body 2 houses a recording head 7 that serves as a "recording unit" configured to perform recording on a paper sheet, which is a "medium". In other words, the printer 1 is configured as a multifunction machine having an ink jet recording function as well as a scanner function.

First, an outline of the scanner unit 3 (see FIG. 1) that reads an image of a document will be described. The scanner unit 3 includes a reading mechanism 3*b* having a document tray 3*a* on which a document is loaded, and a feeding mechanism 3*c* configured to move between a closed position and an open position relative to the reading mechanism 3*b*. In the present embodiment, the feeding mechanism 3*c* is rotatable relative to the reading mechanism 3*b* about the apparatus back end which serves as a rotation axis. When the feeding mechanism 3*c* is at the open position relative to the reading mechanism 3*b*, a document can be set on the document tray 3*a*.

Further, a reading unit (not shown) configured to read a reading surface of the document which is set on the document tray 3*a* is provided in the reading mechanism 3*b*. Further, the feeding mechanism 3*c* is configured to transport the document which is set on the document set unit 3*d* toward the document output tray 3*e* so that the reading surface of the document is read by the reading unit during transportation.

Referring now to the apparatus main body 2, ink container casings 4*a* and 4*b* are provided on the outer surface of the apparatus main body 2. Each ink container casing houses an ink container (not shown) that stores ink. In FIG. 1, the ink container casings 4*a* and 4*b* are provided on both sides in the apparatus width direction (X axis direction). The ink container casing 4*a* disposed on the right in the apparatus width direction houses a plurality of ink containers which correspond to each color of ink, magenta, yellow, and cyan, while the ink container casing 4*b* disposed on the left in the apparatus width direction houses the ink container which stores black ink. The respective ink containers are configured to supply ink to the recording head 7 via an ink tube, which is not shown in the drawing.

In the apparatus main body 2, the recording head 7 is mounted on a carriage 8 which is movable in the X axis direction in FIG. 1. The recording head 7 is configured to perform recording by ejecting ink onto the recording paper, which has been fed to a region which faces the recording head 7.

Sheet Transportation Path in Printer

Next, with reference to FIGS. 2 to 4, a sheet transportation path in the printer 1 will be described. In the lower part of the apparatus main body 2, a paper sheet tray 6 (see also FIG. 1) that houses a plurality of paper sheets P in a housing area 6*a* is provided. The paper sheet P is fed out from the paper sheet tray 6 by the medium transportation device 10. More specifically, the paper sheet P is picked up by a feed roller 12 (also referred to as a pick-up roller), and transported to the apparatus back side (−Y direction) while being nipped between a transportation driving roller 13 that is rotated by a driving source, which is not shown in the figure, to transport the paper sheet P and a separation roller 14 that is driven by rotation of the transportation driving roller 13 and serves as a "driven roller". The paper sheet P is then fed into a curved transportation path 17 which is configured by the intermediate roller 16, and transported to the apparatus front side (+Y direction).

When a plurality of paper sheets P is fed by the feed roller 12, the separation roller 14 cooperates with the transportation driving roller 13 to nip the paper sheets P therebetween and separates them into individual sheets. The separation roller 14 is detachably attached to the paper sheet tray 6 (see FIG. 3). Specifically, as shown in FIG. 4, a roller unit 30 which includes a shaft 31 that penetrates the rotation center of the separation roller 14 is detachable to a holder 40 disposed on the paper sheet tray 6. Detailed configuration of the roller unit 30 and attachment and detachment procedure of the roller unit 30 to the holder 40 will be described later.

A torque limiter 32 (FIG. 4) is mounted on the shaft 31 of the separation roller 14 so as to limit the rotation of the separation roller 14 relative to the shaft at a torque less than a predetermined value, thereby imparting a predetermined rotation resistance. Among the paper sheets P fed out by the feed roller 12, the uppermost sheet is brought into contact with the transportation driving roller 13 that is driven for rotation, thereby receiving a transportation force from the transportation driving roller 13 to be transported downstream. On the other hand, the subsequent paper sheets P, which is about be fed together with the uppermost paper sheet P that should be transported, does not receive a transportation force from the transportation driving roller 13 and is blocked at the position of the separation roller 14. As a result, double feeding is prevented. Details of the separation roller 14 will be described below as the roller unit 30.

In the housing area 6*a* of the paper sheet tray 6 shown in FIG. 3, reference numbers 22, 22 indicate a pair of edge guides 22, 22, which are provided to be movable in a direction (X axis direction) perpendicular to the transportation direction so as to be adjusted for the width of the paper sheet P placed in the housing area 6*a*. Further, reference number 23 indicates a guide 23 that guides a rear edge of the paper sheet P, which is provided to be movable in a direction (Y axis direction) along the transportation direction so as to be adjusted for length of the paper sheet P placed in the housing area 6*a*.

Furthermore, a transportation roller pair 18 is provided on the upstream side in the medium transportation direction with respect to the recording head 7 (on the apparatus back side, −Y direction) so that the paper sheet P is transported to a position under the recording head 7 by the transportation roller pair 18. While being fed toward the apparatus front side, the paper sheet P is supported by the support member 19. When the paper sheet P passes under the recording head 7, recording is performed by ink ejected from the recording head 7. A first output roller pair 20 and a second output roller pair 21 are provided on the downstream side in the medium transportation direction with respect to the recording head 7 (apparatus front side, +Y direction). After recording is performed, the paper sheet P is outputted to the output tray 5 disposed on the apparatus front side.

Roller Unit

The separation roller 14 which constitutes the medium transportation device 10 is configured as the roller unit 30 which includes the shaft 31 that penetrates the rotation center of the separation roller 14. In the roller unit 30, the above-mentioned torque limiter 32 is disposed on the shaft 31. Further, the holder 40 is disposed on the paper sheet tray 6 as a "holding section" so that the roller unit 30 is detachably held by the holder 40.

The roller unit 30 can be removed from the holder 40 by an operator such as a service person or a user when a maintenance operation is required for the separation roller 14 due to continuous use of the printer 1 or the like, and can be again mounted on the holder 40 after cleaning of the roller unit 30 or the like is performed, or alternatively, can be replaced with a new roller unit 30.

The separation roller 14 is biased toward the transportation driving roller 13 (FIG. 2). Specifically, the holder 40 (see FIG. 4) is pivotally mounted about a pivot axis 41 relative to the paper sheet tray 6. The holder 40 is biased by the bias unit 42, and thus the separation roller 14 of the roller unit 30 held by the holder 40 is biased toward the transportation driving roller 13. While the holder 40 biased by the bias unit 42 remains mounted on the paper sheet tray 6, only the roller unit 30 can be removed. Accordingly, the separation roller 14 (roller unit 30) can be easily attached and detached.

Moreover, the medium transportation device 10 further includes a lock mechanism 60 (FIG. 6) that locks the roller unit 30 to the holder 40. The lock mechanism 60 according to the present embodiment is characterized by switching between an unlocked state in which the roller unit 30 is locked to the holder 40 by rotating the separation roller 14 in the medium transportation direction and a locked state in which the roller unit 30 is locked to the holder 40. Details of the configuration of the lock mechanism 60 will be described later.

A first end 31*a* of the shaft 31 of the roller unit 30 has a cross section in a circular shape in a direction perpendicular to the axis direction (see FIG. 5), while a second end 31*b* has a cross section in a truncated circular shape, which is made up of an arch portion 33 and a flat portion 34 (hereinafter, referred to as a D-shape) (see FIG. 6).

The holder 40 (FIGS. 7 and 8) includes a first bearing 43 that receives the first end 31*a* (FIGS. 5 and 6) of the shaft 31 of the roller unit 30 and a second bearing 44 that receives the second end 31*b* (FIGS. 5 and 6). The first bearing 43 is formed as a shaft hole disposed on a first wall 46*a*, which is one of a pair of walls disposed on both sides in the axis direction of the shaft 31 in the holder 40 shown in FIG. 8, so that the first end 31*a* (FIGS. 5 and 6) of the shaft 31 can be inserted therein. The second bearing 44 is formed as a groove disposed on a second wall 46*b*, which is the other of the pair of walls in the holder 40 shown in FIGS. 7 and 8, so that the second end 31*b* (FIGS. 5 and 6) of the shaft 31 can be inserted therein from above the second wall 46*b*.

As shown in the top figure in FIG. 9, the first end 31*a* (not illustrated in FIG. 9) of the shaft 31 is inserted into the first bearing 43 (shaft hole) of the holder 40 (see FIG. 8) with the roller unit 30 being inclined. Then, as shown in the middle figure in FIG. 9, the second end 31*b* is inserted into the second bearing 44 (groove). After that, the roller unit 30 is locked by the lock mechanism 60. Since the first bearing 43 into which the first end 31*a* is inserted is a shaft hole, and the second bearing 44 into which the second end 31*b* is inserted is a groove, the roller unit 30 can be reliably mounted on the holder 40 in a simple manner. In the following description, a configuration of the lock mechanism 60 is first described, and then a series of operation by which the roller unit 30 is mounted on the holder 40 will be described.

Lock Mechanism

The lock mechanism 60 (see FIGS. 5 and 6) is fixed to the shaft 31 of the roller unit 30, and is provided with a contact member 61 that protrudes in a direction perpendicular to the axis direction of the shaft 31. The contact member 61 is disposed on the D-shaped second end 31*b* having the cross section made up of the arch portion 33 and the flat portion 34, and is more tightly fixed to the shaft 31.

The holder 40 (FIGS. 7 and 8) includes a regulation member 45 (FIGS. 7 and 8) that regulates rotation of the shaft 31 in the medium transportation direction (the direction indicated by the arrow A in FIG. 4) by being in contact with the contact member 61 as shown in FIG. 4 and the bottom figure in FIG. 9 while the first end 31*a* and the second end 31*b* are received in the first bearing 43 and the second bearing 44, respectively.

In the lock mechanism 60, the locked state is a state in which the contact member 61 is in contact with the regulation member 45 as shown in the bottom figure in FIG. 9 and the lower figure in FIG. 11, while the unlocked state is a state in which the shaft 31 has been rotated from the locked state in a direction opposite to the medium transportation direction (the direction indicated by the arrow A) and the contact member 61 is spaced from the regulation member 45 as shown in the middle figure in FIG. 9 and the upper figure in FIG. 11.

The contact member 61 includes a tab 62 which extends in a direction perpendicular to the axis direction of the shaft 31 (X axis direction in FIGS. 5 and 6). Further, the contact member 61 of the present embodiment includes a tongue 63 disposed on the opposite side to the tab 62 with the shaft 31 interposed therebetween as shown in FIG. 6. The tongue 63 is elastically deformable in the axis direction (X axis direction), and is provided with a projection 64 on a surface facing the second wall 46*b* (FIG. 7). Further, in the present embodiment, the contact member 61, the tab 62 and the tongue 63 are integrally formed of a resin material or the like which can be elastically deformable.

Attachment Procedure of Roller Unit to Holder and Lock Procedure of Lock Mechanism Referring to FIGS. 9 and 11, an attachment procedure of the roller unit 30 to the holder 40 and a lock procedure of the lock mechanism 60 will be described. As described above, the first end 31*a* of the shaft 31 is first inserted into a shaft hole which is the first bearing 43 (FIG. 8) of the holder 40 with the roller unit 30 being inclined as shown in the top figure in FIG. 9, and then the second end 31*b* is fitted in the groove which is the second bearing 44. Thus, the roller unit 30 is set in the holder 40 as shown in the middle figure in FIG. 9 and the upper figure in FIG. 11.

In this state, the contact member 61 of the lock mechanism 60 is not in contact with the regulation member 45 of the holder 40 as shown in the upper figure in FIG. 11, and the lock mechanism 60 is in the unlocked state. Here, when the separation roller 14 is rotated in the medium transportation direction, that is, the direction indicated by the arrow A, the contact member 61 is brought into contact with the regulation member 45 so that the lock mechanism 60 becomes the locked state as shown in the bottom figure in FIG. 9 and the lower figure in FIG. 11. The roller unit 30 can be removed from the holder 40 by the procedure opposite to the aforementioned attachment procedure (the procedure from the bottom figure to the top figure in FIG. 9).

In addition, the separation roller 14 is provided such that a predetermined rotation resistance is imparted to the shaft 31 by the torque limiter 32. Accordingly, as the tab 62 disposed on the contact member 61, which is fixed to the shaft 31, is rotated in the direction indicated by the arrow A, the separation roller 14 is also rotated in the direction indicated by the arrow A. As a matter of course, the separation roller 14 can be rotated by an external force being directly applied. If the shaft 31 is rotated by an external force, the separation roller 14 can also be integrally rotated with the shaft 31. In the locked state, the contact member 61 fixed to the shaft 31 is in contact with the regulation member 45. Accordingly, the shaft 31 is regulated from rotating in the medium transportation direction (the direction indicated by the arrow A) and fixed in position. In the locked state in which the shaft 31 is fixed, when the transportation driving roller 13 rotates to cause a force exceeding the rotation resistance imparted by the torque limiter 32 to be applied on the separation roller 14, the separation roller 14 can rotate relative to the shaft 31.

In the shaft 31 of the roller unit 30, when the second end 31*b* with the D-shaped cross section having the arch portion 33 and the flat portion 34 is attached to and detached from second bearing 44 formed as a groove, the flat portion 34 extends in the groove depth direction (Z axis direction) as shown in the upper figure in FIG. 11. Accordingly, the second end 31*b* is attached and detached without being caught by the second bearing 44. Then, when the lock mechanism 60 becomes the locked state, the arch portion 33 of the second end 31*b* extends along the bottom of the second bearing 44 formed in the arch shape corresponding to the arch portion 33 as shown in the lower figure in FIG. 11. Accordingly, the second end 31*b* is held by the second bearing 44 in a stable manner.

As described above, the lock mechanism 60 is configured to switch between the unlocked state in which the holder 40 is unlocked and the locked state in which the holder 40 is locked by rotating the separation roller 14 in the medium transportation direction. Accordingly, the lock mechanism 60 is ensured to be in the locked state in a reliable manner after the separation roller 14 is attached and detached. For example, in the roller unit 30 which is already attached to the holder 40, if the transportation driving roller 13 is driven to start transportation when locking by the lock mechanism 60 is insufficient (in the unlocked state), the lock mechanism 60 can be turned into the locked state by rotation of the transportation driving roller 13 which causes the separation roller 14 to rotate in the medium transportation direction. Accordingly, transportation of the paper sheet P while the lock mechanism 60 is in the unlocked state can be reduced or avoided.

Moreover, the locked state and the unlocked state of the lock mechanism 60 can be switched by a simple operation by an operator holding the tab 62 of the contact member 61 which is fixed to the shaft 31 to rotate the shaft 31 of the roller unit 30.

Positioning of the Shaft of Roller Unit in the Holder

Next, referring to FIGS. 10 to 13, positioning of the shaft 31 of the roller unit 30 in the holder 40 will be described. On the second wall 46*b* (FIG. 10) of the holder 40, there are provided a recessed portion 47 which is located at a larger distance from the first wall 46*a*, and a raised portion 48 which protrudes more toward the first wall 46*a* than the recessed portion 47 is and is located at a smaller distance from the first wall 46*a*. Further, FIG. 11 is a cross-sectional view taken along the XI-XI which illustrates that the roller unit 30 is set in the holder 40 shown in FIG. 10, and FIG. 12 is a cross-sectional view taken along the XII-XII.

In the unlocked state (the upper figure in FIG. 11) in the lock mechanism 60, the projection 64 on the tongue 63 faces the recessed portion 47 of the second wall 46*b* with a space therebetween as shown in the top view in each of FIGS. 12 and 13. During transition from the unlocked state to the locked state (the lower figure in FIG. 11) in the lock mechanism 60, the raised portion 48 of the second wall 46*b* presses the projection 64 to elastically deform the tongue 63 toward inside in the axis direction of the shaft 31 (+X direction) as shown in the middle figure in each of FIGS. 12 and 13.

Since the projection 64 of the tongue 63 faces the recessed portion 47 on the second wall 46*b* with a space therebetween in the unlocked state in the lock mechanism 60, an allowance in the X axis direction is provided between the holder 40 and the roller unit 30, facilitating setting of the roller unit 30. Moreover, since the projection 64 is pressed by the raised portion 48 of the second wall 46*b* during transition from the unlocked state to the locked state (the lower figure in FIG. 11) in the lock mechanism 60, the tongue 63 elastically deforms toward inside in the axis direction of the shaft 31 (+X direction), and accordingly, the roller unit 30 is also pressed in the +X direction. As a result, the first end 31*a* which is the +X end of the shaft 31 is reliably inserted into the first bearing 43, allowing the shaft 31 to be positioned in the axis direction (X axis direction).

Further, an inclined surface 49 is disposed between the recessed portion 47 and the raised portion 48 to be continuous from the recessed portion 47 to the raised portion 48. Since the recessed portion 47 and the raised portion 48 are connected to each other via the inclined surface 49, the projection 64 on the tongue 63 can be guided by the inclined surface 49 and is allowed to smoothly move from the recessed portion 47 to the raised portion 48 or from the raised portion 48 to the recessed portion 47. Accordingly, the unlocked state and the locked state in the lock mechanism 60 can be smoothly switched.

Moreover, the second wall 46*b* is further provided with a step 50 (a portion surrounded by the dot and dashed line in FIG. 10) which serves to release elastic deformation of the tongue 63 on the raised portion 48 when the lock mechanism 60 becomes the locked state. The step 50 is recessed from the raised portion 48 to the extent smaller than the recess of the recessed portion 47. For example, the step 50 is recessed to the extent approximately the same as the protruding amount of the projection 64. When the lock mechanism becomes the locked state, the projection 64 on the tongue 63 is escaped to the step 50 as shown in the bottom view in each of FIGS. 12 and 13. Accordingly, the projection 64 on the tongue 63 is released from the state pressed by the raised portion 48, thereby allowing elastic deformation of the tongue 63 to be released.

When the projection 64 on the tongue 63 transitions from the raised portion 48 to the step 50, the projection 64 on the tongue 63 makes a sound by contact with the step 50. In addition, when switching of the lock mechanism 60 is performed by operating the tab 62 by hand, releasing of elastic deformation of the tongue 63 can be recognized when the projection 64 on the tongue 63 transitions from the raised portion 48 to the step 50. This facilitates recognition of when the lock mechanism 60 becomes the locked state.

Other Configurations of Roller Unit

In the roller unit 30, the first end 31*a* of the shaft 31 has a guiding feature that guides insertion of the first end 31*a* into the first bearing 43. In the present embodiment, the first end 31*a* has a tapered portion 35 on the end thereof as shown in FIG. 5. This facilitates insertion of the first end 31*a* into the first bearing 43. Further, the guiding feature that guides insertion of the first end 31*a* into the first bearing 43 may be disposed on the first bearing 43 of the holder 40 (FIG. 8). For example, the first bearing 43 may be tapered in the insertion direction of the shaft 31 (+X direction). Alternatively, the guiding feature may also be disposed on both the first end 31*a* and the first bearing 43.

In the present embodiment, the contact member 61 is fixed to the shaft 31, and the separation roller 14 is provided in a configuration in which a predetermined rotation resistance is imparted to the shaft 31 by the torque limiter 32. However, the contact member 61 (lock mechanism 60) may be disposed in a configuration in which a predetermined rotation resistance is imparted to the shaft 31 by the torque limiter, while the separation roller 14 is fixed to the shaft 31, so that the separation roller 14 rotates as the shaft 31 rotates.

Embodiment 2

Figure 14:
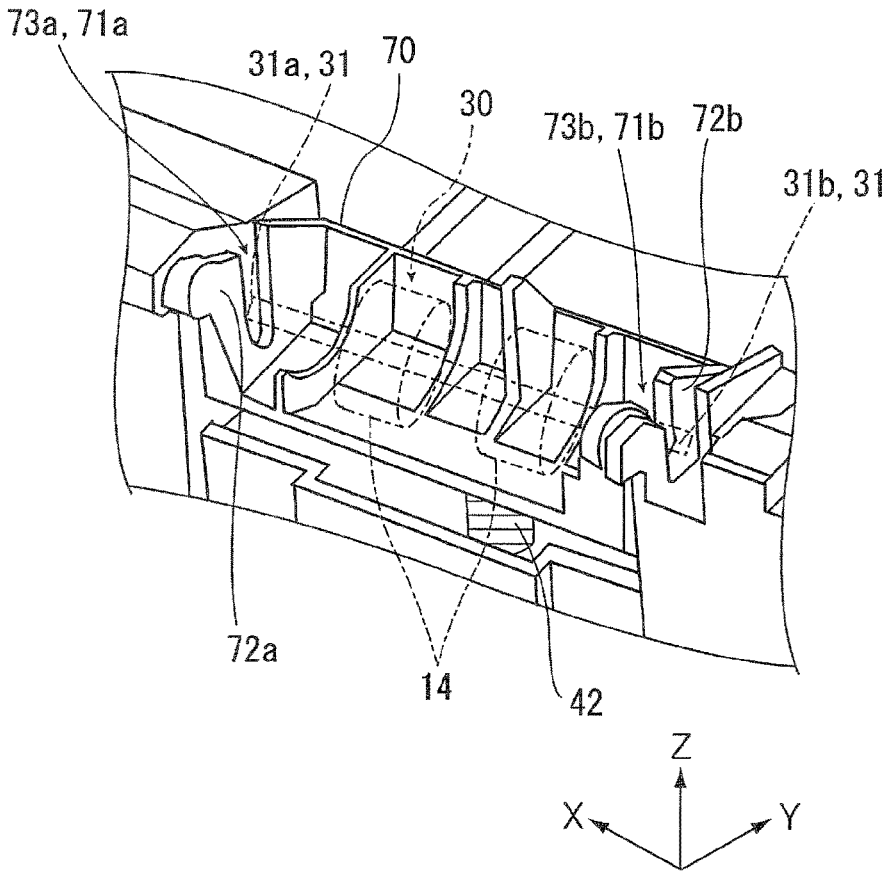
FIG. 14 is a perspective view of another example of the holder.

In this embodiment, with reference to FIG. 14, another example of the holder which serves as a "holding section" that holds the roller unit 30 will be described. FIG. 14 is a perspective view of another example of the holder. In this embodiment, the same reference numbers are given to the same components as those of Embodiment 1, and the description thereof is omitted.

As shown in FIG. 14, a holder 70 described in the present embodiment is characterized in that a first bearing 71*a* and a second bearing 71*b* that receive the first end 31*a* and the second end 31*b* of the shaft 31 in the roller unit 30, respectively, which is indicated by the dot and dashed line in FIG. 14, are formed in a groove shape. That is, the first bearing 71*a* is a first groove 73*a* disposed on the first wall 72*a* of the holder 70 so that the first end 31*a* of the shaft 31 can be inserted from above the first wall 72*a*, and the second bearing 71*b* is a second groove 73*b* disposed on the second wall 72*b* so that the second end 31*b* of the shaft 31 can be inserted from above the second wall 72*b*.

In the holder 70, since both the first bearing 71*a* and the second bearing 71*b* are formed as a groove (the first groove 73*a* and the second groove 73*b*), the first end 31*a* and the second end 31*b* can be easily mounted on the first bearing 71*a* and the second bearing 71*b*, respectively. In the present embodiment, both the first end 31*a* and the second end 31*b* of the roller unit 30 of the shaft 31 preferably have a D-shaped cross section. Providing the first end 31*a* and the second end 31*b* with a D-shaped cross section enables the both ends to be attached to and detached from the corresponding bearings. Furthermore, when the lock mechanism 60 becomes the locked state, the first end 31*a* and the second end 31*b* can be held in the first bearing 71*a* and the second bearing 71*b*, respectively, in a stable manner. The first end 31*a* may have a circular cross section, and the second end 31*b* may have a D-shaped cross section as with Embodiment 1.

In addition, it should be noted that the disclosure is not limited to the above embodiments. Various modifications are contemplated within the scope of the disclosure as defined in the appended claims, and these should be included in the scope of the disclosure.

What is claimed is:

1. A medium transportation device comprising:

a transportation driving roller that transports a medium;

a roller unit including a driven roller that is rotated by the rotation of transportation driving roller and a shaft which penetrates a rotation center of the driven roller;

a holding section that detachably holds the roller unit; and a lock mechanism that switches between a locked state in which the roller unit is locked to the holding section and an unlocked state in which locking is released, wherein the lock mechanism causes the roller unit to be switched from the unlocked state to the locked state when the driven roller of the roller unit in the unlocked state is rotated in a medium transportation direction by rotation of the transportation driving roller.

2. The medium transportation device according to claim 1, wherein the driven roller is configured to rotate integrally with the shaft when the lock mechanism is in the unlocked state, and to be relatively rotatable to the shaft when the lock mechanism is in the locked state.

3. The medium transportation device according to claim 2, wherein the lock mechanism includes a contact member that is fixed to the shaft and protrudes in a direction perpendicular to an axis direction of the shaft, the holding section includes a first bearing that receives a first end of the shaft, a second bearing that receives a second end, and a regulation member that regulates the shaft from rotating in the medium transportation direction by contact with the contact member in a state in which the first end and the second end are received in the first bearing and the second bearing, respectively, and in the lock mechanism, the locked state is a state in which the contact member is in contact with the regulation member, and the unlocked state is a state in which the shaft has been rotated from the locked state in a direction opposite to the medium transportation direction and the contact member is spaced from the regulation member.

4. The medium transportation device according to claim 3, wherein the first end of the shaft has a cross section of a circular shape in a direction perpendicular to an axis direction, and the second end has a cross section of a truncated circular shape which is made up of an arch portion and a flat portion, and the contact member is disposed on the second end.

5. The medium transportation device according to claim 4, wherein the first bearing is a shaft hole disposed on a first wall, which is one of a pair of walls disposed on both sides in the axis direction of the shaft in the holding section, and allows the first end of the shaft to be inserted therein, and the second bearing is a groove disposed on a second wall of the pair of walls and allows the second end of the shaft to be inserted therein from above the second wall.

6. The medium transportation device according to claim 3, wherein the first bearing is a first groove disposed on a first wall, which is one of a pair of walls disposed on both sides in the axis direction of the shaft in the holding section, and allows the first end of the shaft to be inserted therein from above the first wall, and the second bearing is a second groove disposed on a second wall of the pair of walls and allows the second end of the shaft to be inserted therein from above the second wall.

7. The medium transportation device according to claim 3, wherein the contact member includes a tab which extends in a direction perpendicular to the axis direction of the shaft.

8. The medium transportation device according to claim 5, wherein the contact member includes a tab disposed on the second end and extends in a direction perpendicular to the axis direction of the shaft, and a tongue disposed on an opposite side to the tab with the shaft interposed therebetween, the tongue being elastically deformable in the axis direction and provided with a projection on a surface facing the second wall, and the second wall includes a recessed portion which faces the projection of the tongue with a space therebetween in the unlocked state of the lock mechanism, and a raised portion which presses the projection to elastically deform the tongue toward inside in the axis direction of the shaft while the lock mechanism transitions from the unlocked state to the locked state.

9. The medium transportation device according to claim 8, wherein the second wall includes an inclined surface which is continuous from the recessed portion to the raised portion.

10. The medium transportation device according to claim 8, wherein the second wall includes a step which serves to release elastic deformation of the tongue on the raised portion when the lock mechanism becomes the locked state.

11. The medium transportation device according to claim 5, wherein at least one of the first end and the first bearing of the shaft has a guiding feature that guides insertion of the first end into the first bearing.

12. The medium transportation device according to claim 2, wherein the driven roller is a separation roller that cooperates with the transportation driving roller to nip the medium therebetween for separation, and the roller unit includes a torque limiter that limits rotation of the separation roller relative to the shaft at a torque less than a predetermined value.

13. A recording apparatus comprising:

a recording unit that performs recording on the medium; and the medium transportation device according to claim 1 that transports the medium to the recording unit.

14. The recording apparatus according to claim 13, comprising:

an apparatus main body that houses the recording unit and the transportation driving roller; and a paper sheet tray that is detachable to the apparatus main body, wherein the roller unit and the holding section are disposed on the paper sheet cassette, and are removable from the apparatus main body together with the paper sheet tray.

* * * * *